US005758716A

United States Patent [19]

Shibata

[11] Patent Number: 5,758,716

[45] Date of Patent: Jun. 2, 1998

[54] RADIATOR UNIT FOR INTERNAL COMBUSTION ENGINE

[75] Inventor: Yuichi Shibata, Isehara, Japan

[73] Assignee: Nissan Motor Co., Ltd., Yokohama, Japan

[21] Appl. No.: 623,781

[22] Filed: Mar. 29, 1996

[30] Foreign Application Priority Data

Mar. 30, 1995 [JP] Japan ..... 7-073346

[51] Int. Cl.[6] ..... F01P 11/00; F04D 29/54

[52] U.S. Cl. ..... 165/41; 165/51; 165/121; 165/122; 415/119; 415/191; 415/208.1; 415/914; 123/41.49

[58] Field of Search ..... 165/121, 122, 165/41, 51; 415/119, 191, 208.1, 914; 123/41.49

[56] References Cited

U.S. PATENT DOCUMENTS

| | | | |
|---|---|---|---|
| 1,966,787 | 7/1934 | Buri | 165/121 |
| 4,210,833 | 7/1980 | Neveux | 165/121 |
| 4,548,548 | 10/1985 | Gray, III | 416/189 |
| 4,685,513 | 8/1987 | Longhouse et al. | 165/121 |
| 5,466,120 | 11/1995 | Takeuchi et al. | 415/119 |

FOREIGN PATENT DOCUMENTS

| | | | |
|---|---|---|---|
| 4105378 | 8/1992 | Germany | 415/119 |
| 4305928 | 9/1994 | Germany | 415/208.1 |
| 0200097 | 11/1983 | Japan | 415/119 |
| 3-189304 | 11/1983 | Japan | 415/119 |
| 4-124422 | 4/1992 | Japan . | |
| 0943410 | 7/1982 | U.S.S.R. | 415/119 |
| 2070688 | 9/1981 | United Kingdom | 415/119 |

*Primary Examiner*—John K. Ford
*Attorney, Agent, or Firm*—Foley & Lardner

[57] ABSTRACT

A radiator unit for an internal combustion engine of a vehicle is comprised of a radiator disposed in the vicinity of the engine. A fan shroud including stays is connected to the radiator and disposed between the radiator and the engine. A motor with a fan is installed to the stays so that the stays are located between the radiator and the fan. Therefore, the clearance between the radiator and the fan is increased without approaching the stays and the motor toward the engine to improve the heat transferring ability.

7 Claims, 4 Drawing Sheets

RADIATOR UNIT FOR INTERNAL COMBUSTION ENGINE

BACKGROUND OF THE INVENTION

The present invention relates to a radiator unit for an internal combustion engine installed to a vehicle. A variety of radiator units have been proposed and in practical use. Japanese Patent Provisional Publication No. 4-124422 discloses a typical radiator unit for an automotive vehicle equipped with a transverse engine of front engine front drive type. The radiator unit includes a radiator which is installed to a front portion in an engine compartment of the vehicle and a fan shroud to which a motor with a fan is installed. The fan functions to forcibly direct outer air to the radiator when the ram air of the vehicle is not sufficient to keep a predetermined heat transferring ability of the radiator and to cool the engine. The fan shroud has two cylindrical members which define two openings side by side, and functions to improve the efficiency of the fan. From projecting periphery of each cylindrical member, three stays of a channel shape extend to a small center ring member coaxial with the cylindrical member. The motor with the fan is installed to the small ring member.

However, since the fan is disposed adjacent to the radiator to have a small clearance therebetween, the improvement of the radiator unit is restricted by this small clearance. If the clearance between the radiator and the fan is increased in this arrangement, the stays and the fan approach the engine and strongly receive the radiation heat of the engine. Further, the stays do not effectively function to improve in the air passing ability and the noise reduction due to the shape thereof.

SUMMARY OF THE INVENTION

It is an object of the present invention to provide an improved radiator unit which ensures a clearance between a fan and a radiator to improve in the air passing ability and the noise reduction.

A radiator unit according to the present invention is for an internal combustion engine of a vehicle and comprises a radiator which is disposed in the vicinity of the engine. A shroud is connected to the radiator so as to be located between the radiator and the engine. The shroud includes a base frame which defines an opening and a plurality of stays which extends from the base frame toward a center of the opening. A motor is connected to the stays and connected with a fan. The stays are located between the radiator and the fan. Each of the stays is formed into a stationary blade shape which has a first angle with respect to the fore-and-aft direction of the vehicle. The first angle of the stay is different from an angle of a blade of the fan.

DETAILED DESCRIPTION OF THE INVENTION

Referring to FIGS. 1 to 6, there is shown an embodiment of a radiator unit according to the present invention.

Figure 2:
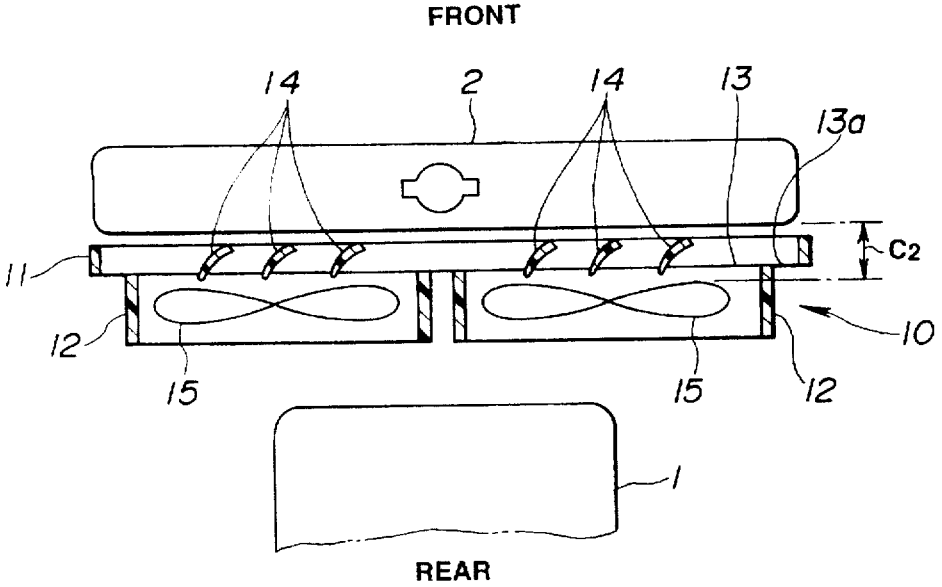
FIG. 2 is a cross-sectional view of FIG. 1 taking in the direction of arrows substantially along the line II—II.

As shown in FIG. 2, in an engine compartment of an automotive vehicle, a radiator 2 is disposed forward an engine 1. Between the radiator 2 and the engine 1, a fan shroud 10 is installed to the radiator 2. The fan shroud 10 comprises a base frame 11 of a rectangular shape which defines an opening that is generally the same in size as a core of the radiator 2. A plurality of stays 14 extend from the base frame 11 to two ring members 16 each of which is positioned so as to have an axis corresponding to each of centers C of fans 15 and electric motors 17 to be coaxially installed therewith. The electric motors 17 are controlled by a controller (not show) according to thermal information of the engine.

Figure 1:
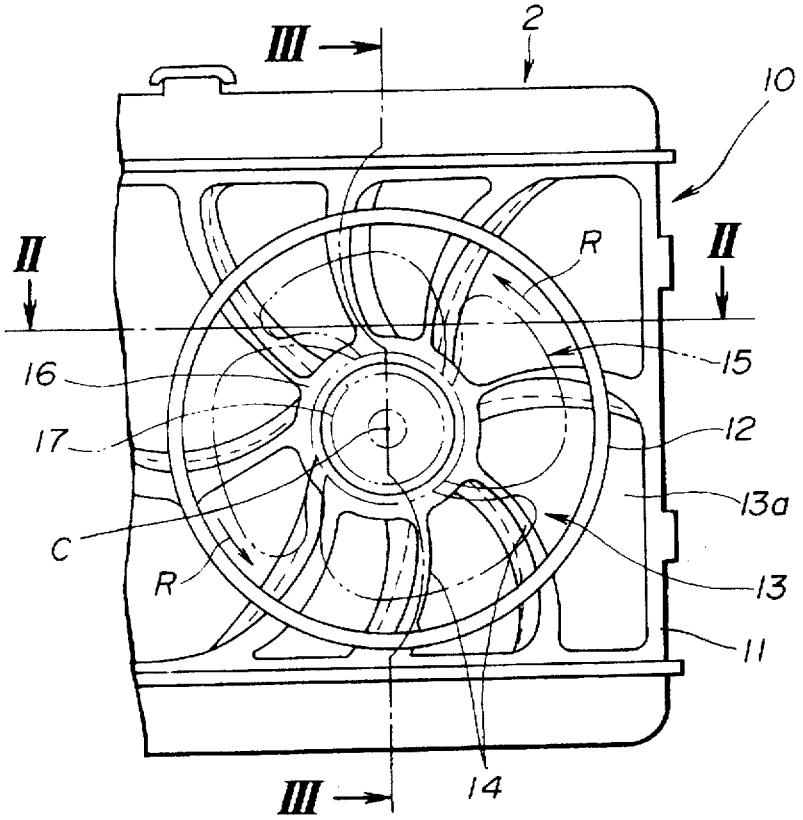
FIG. 1 is a rear view of a radiator unit of an embodiment according to the present invention.
Figure 3:
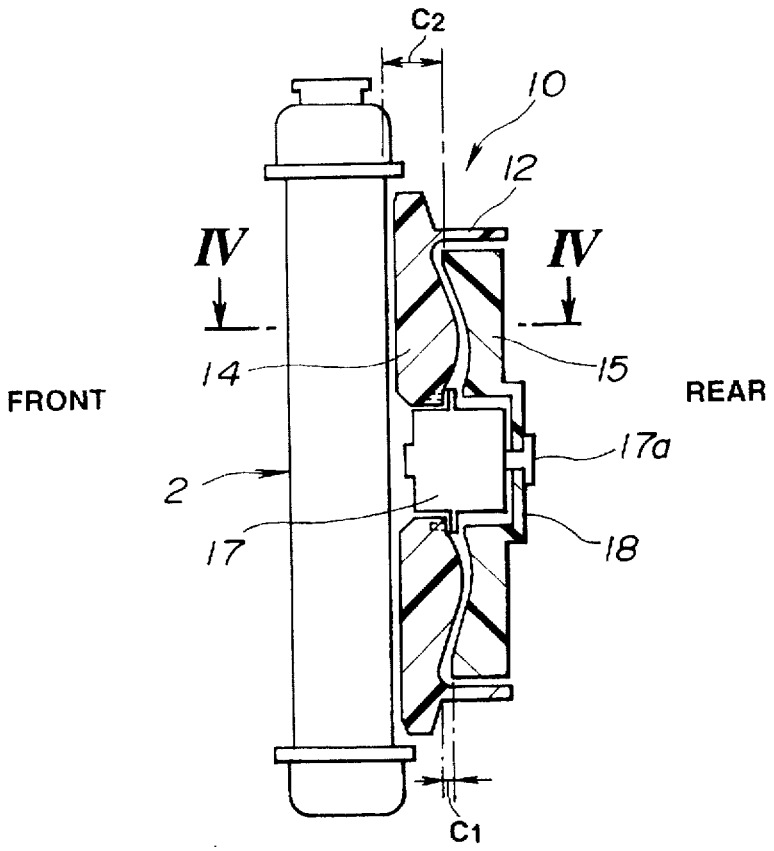
FIG. 3 is a cross-sectional view of FIG. 1 taking in the direction of arrows substantially along the line III—III.
Figure 4:
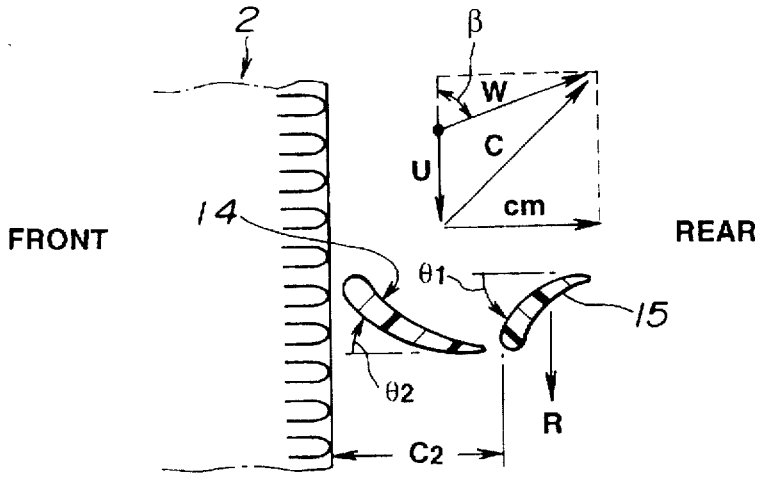
FIG. 4 is a cross-sectional view taking in the direction of arrows substantially along the line IV—IV of FIG. 3.

Two cylindrical members 12 are integrally connected with the stays 14 so as to be coaxial with ring members 16, respectively. The center of the cylindrical member 12 and the ring member 16 is the same as each center C. Each of the cylindrical members 12 has an opening 13 through which air directed by the fan 15 is blown out. Outside the cylindrical member 12, the base frame 11 and the stays 14 define other openings 13*a* through which ram air passes. The base frame 11, the stays 14, ring members 15 and cylindrical members 12 are integrally formed. As shown in FIGS. 2 and 3, the cylindrical members 12 extend from the stays 14 toward the engine 1. Each of the stays 14 is formed into a stationary blade shape which has a predetermined angle (oblique angle) $\theta_2$ with respect to the fore-and aft direction of the vehicle as shown in FIG. 4. More particularly, the blade-shaped stay 14 is formed such that a front side thereof is directed against the rotational direction R of the fan 15 while forming the angle $\theta_2$ with respect to the fore-and-aft direction of the vehicle. The stays 14 are disposed adjacent to the rear side of the radiator 2 in the fore-and-aft direction of the vehicle. Each of the stays 14 is formed into an arc-shape which is curved toward the rotational direction R of the fan 15 as shown in FIG. 1.

The electric motors 17 are connected to the respective ring members 16. An output shaft 17*a* of the electric motor 17 projects rearward and is connected to the fan 15 which has four blades. Each of the blades of the fan 15 has a predetermined angle (oblique angle) $\theta_1$ with respect to an center axis of the fan 15 which angle $\theta_1$ is different from the angle $\theta_2$. As shown in FIG. 4, the blades of the fan 15 are formed such that a front side thereof is directed toward the rotational direction R of the fan 15 while forming the angle $\theta_1$ with respect to the fore-and-aft direction of the vehicle. The fan 15 includes a cover portion 18 which covers a rear portion of the electric motor 17. The fan 15 faces to the stays 14 and is surrounded by the cylindrical member 12. As shown in FIG. 2, due to the installation of the stays 14 between the radiator 2 and the fan 15, a predetermined clearance $C_2$ is formed between the radiator 2 and the fan 14. Further, the stays 14 and the fan 15 are adjacently arranged to form a small and equal clearance $C_1$ therebetween as shown in FIG. 3.

A variety of functions obtained by the radiator unit according to the present invention will be discussed hereinafter.

Advantage due to the Increase of the Clearance C2

Figure 5:
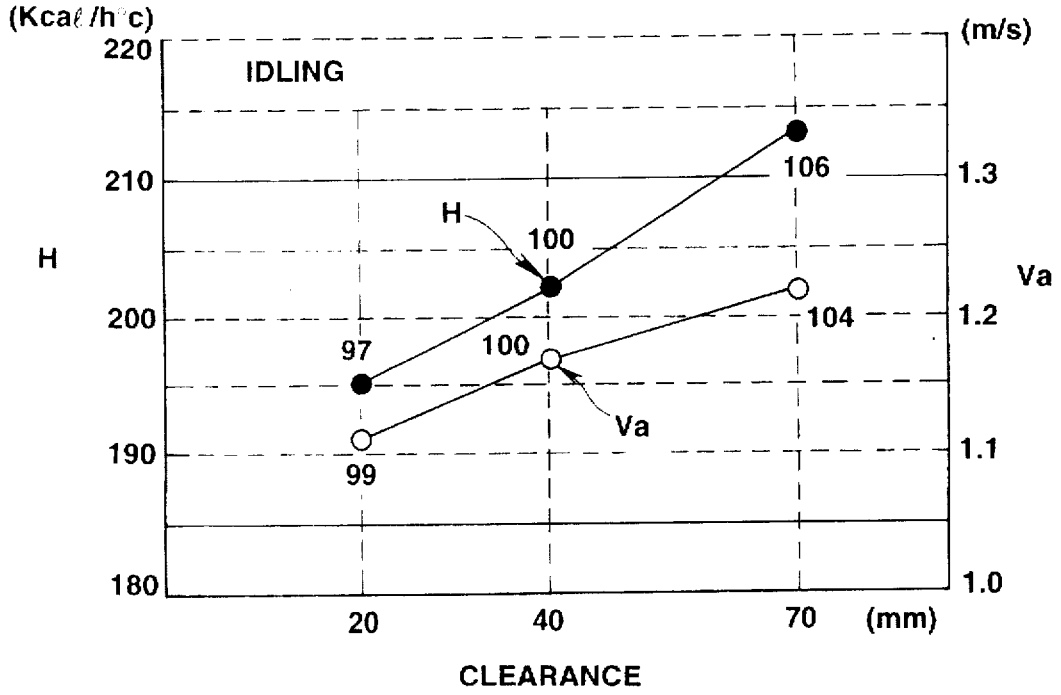
FIG. 5 is a graph which shows a relationship between the clearance vs. the heat transfer rate and the air passing speed under idling condition.
Figure 6:
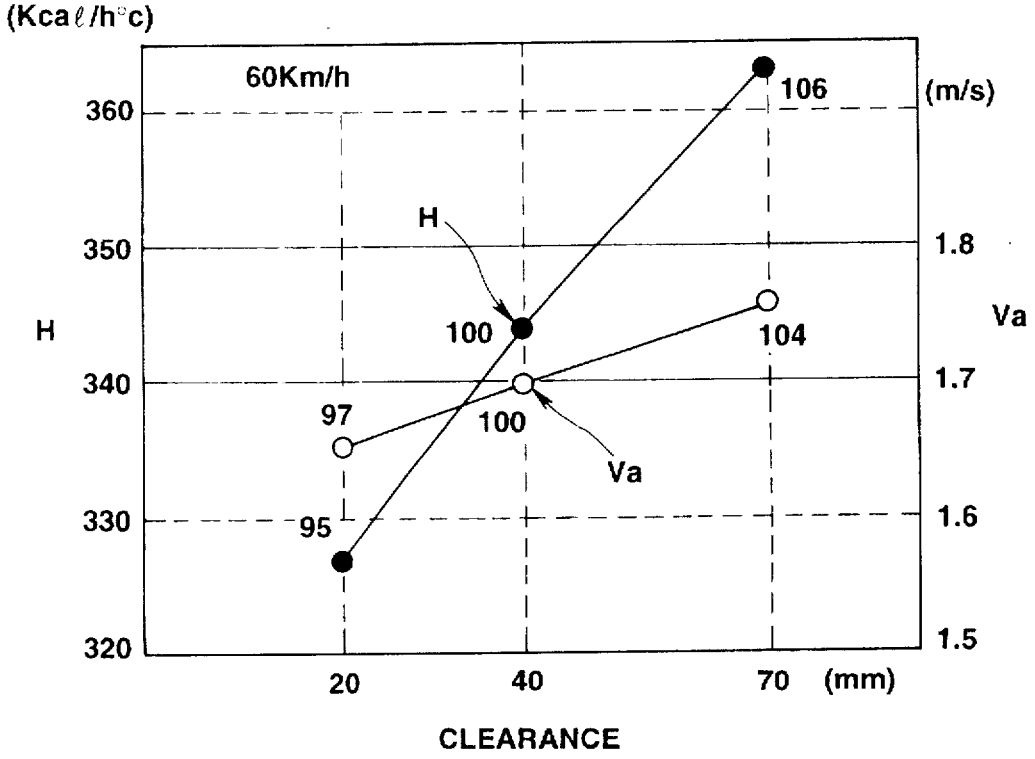
FIG. 6 is a graph which shows a relationship between the clearance vs. the heat transfer rate and the air passing speed under 60 km/h traveling condition.

By the installation of the stays 14 between the radiator 2 and the fans 15, the clearance $C_2$ between the radiator 2 and the fans 15 is increased, and therefore the heat transferring ability is increased by the increase of the air passing through the radiator 2. FIGS. 5 and 6 show the result of the experiments which were executed as to the relationships between the clearance $C_2$ and the heat transfer rate H and between the clearance $C_2$ and the air passing speed Va under vehicle conditions of idling and 60 km/h speed traveling. A graph of FIG. 5 shows the result under the idling condition, and the graph of FIG. 6 shows the result under 60 km/h speed traveling condition. In these graphs, the data were obtained by setting the clearance $C_2$ at 20 mm, 40 mm and 70 mm clearances and were compared with each other upon being standardized such that the data of 40 mm was 100%. As is clear from the graphs of FIGS. 5 and 6, the increase of the clearance $C_2$ from 20 mm to 70 mm raised up the heat transfer rate H from 97% to 106% under the idling condition and from 99% to 106% under the 60 km/h speed traveling condition. Further, as to the air passing speed Va, this increase of the clearance from 20 mm to 70 mm raised up the ratio of the air passing speed Va from 99% to 104% under the idling condition and from 97% to 104% under the 60 km/h speed traveling condition.

That is, the improvement in the heat transferring ability due to the increase of the air passing speed is accomplished by that the ventilation resistance of the radiator unit is decreased and that the distribution of the air flow through the radiator unit is improved. In addition, since the fan 15 is covered by the cylindrical member 12, the blowing ability of the fan 15 is improved.

Heat Resistance of the Fan 15

Although the fan 15 approaches the engine 1 according to the increase of the clearance $C_2$, the fan 15 cools itself so as to be durable to the radiation heat from the engine 1. Accordingly, it is not necessary to specially prepare a fan made of expensive high-resisting material. Further, since the electric motor 17 is covered with the cover portion 18 of the fan 15, the electric motor 17 is protected from the radiation heat of the engine 1.

Flow Straightening by Means of the Stays 14

Each of the stays 14 is formed into a stationary blade having the angle $\theta_2$ which is different from the angle $\theta_1$ of the fan 15. Accordingly, the air passed through the radiator 2 is straightened (changed into laminar flow) by the stays 14, and the noise due to the turbulent flow of the air is reduced. Further, the passing speed of the air through the radiator 2 is increased by this straightened flow. That is, as shown in FIG. 4, the stays 14 straighten the air (make the air into laminar flow) and increase the oblique $\beta$ of the relative speed W of the air. Therefore, the absolute speed C directing from front to rear of the vehicle, which is the vector sum of the vector of the relative speed W and the vector of the circumferential speed U, is increased, and therefore the passing speed Cm is increased according to the increase thereof. Accordingly, the heat transferring ability of the radiator 2 is increased according to the increase of the passing speed Cm.

Further, since the stays 14 are formed into an arc shape directing to the rotational direction R of the fan 15 and adjacent to the respective fans 15 with a predetermined clearance C1, the stays 14 improve the air flow to a laminar flow.

Sound Insulation by Means of the Stays 14

The stays 14 formed into wide-width blades function to suppress the engine noise from being heard outside the vehicle through the openings 13, as compared with a conventional case that the stays of narrow-width blades are used in the radiator unit. Since each of the stays 14 is formed into a blade shape while having a wide-width, the passage resistance thereby is not increased.

Figure 7:
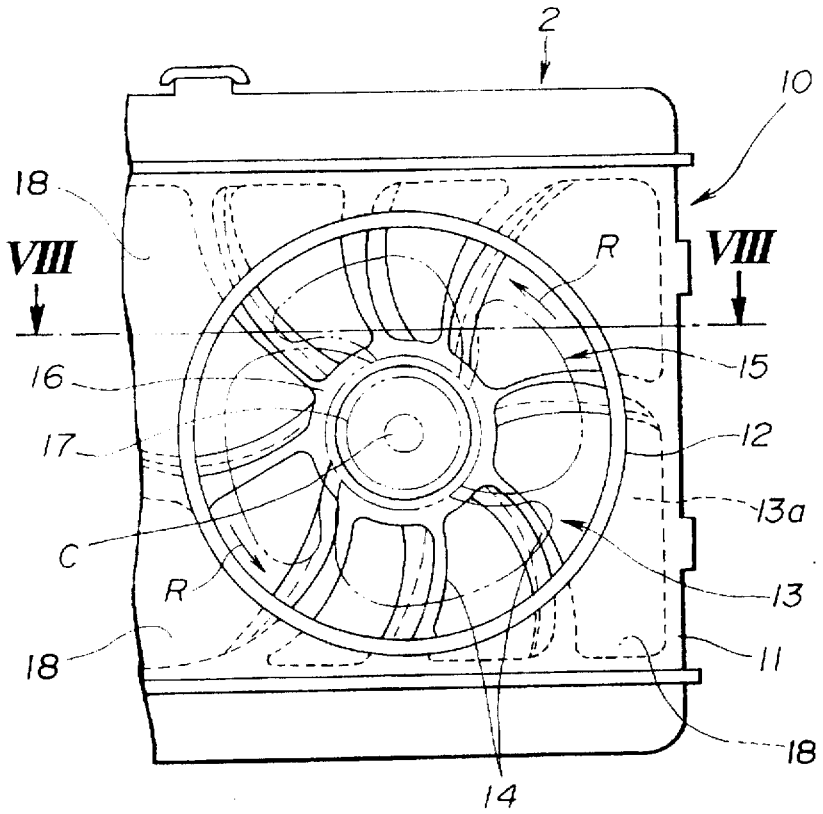
FIG. 7 is a rear view of the radiator unit of a second embodiment according to the present invention.
Figure 8:
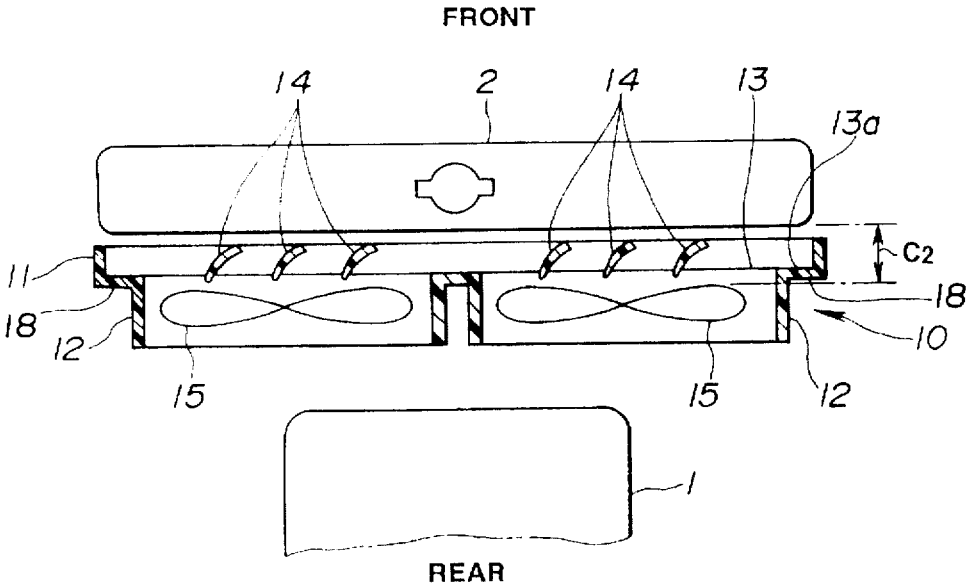
FIG. 8 is a cross-sectional view of FIG. 7 taking in the direction of arrows substantially along the line VIII—VIII.

Referring to FIGS. 7 and 8, there is shown a modification of the embodiment of the radiator unit according to the present invention. This modified example is the same as the above embodiment except that an outer cover 18 is integrally connected to the base frame 11 and the stays 14 so as to close the openings 13*a*. Therefore, this modified example basically performs the above discussed functions as is similar to that of the above mentioned embodiment.

By the installation of the cover member 18, this modified radiator unit functions to suppress hot air in the engine compartment from being involved into the radiator during an extremely low speed moving such as a movement in a traffic jam. That is, the radiator unit of this modified type is preferably applied to vehicles used in a country having a heavy traffic on roads such as in Japan.

In contrast, the radiator unit of a former mentioned type shown in FIG. 1 has a function such that the openings 13*a* feed lot of ram air the radiator so as to effectively cool the engine coolant during a high speed cruising. Therefore, this former type (lam air guiding type) is preferably applied to vehicles used in a country where the weather is basically cold and the vehicles are driven in a relatively high speed.

Although the preferred embodiments of the present invention have been shown and described as to a radiator unit for an internal combustion engine of the automotive vehicle, it will be understood that the present invention may be applied to a radiator unit not for a vehicle engine.

While the invention has been shown and described with reference to preferred embodiments thereof, it will be understood that foregoing and other changes in form and details can be made therein without departing from the spirit and scope of the invention.

What is claimed is:

1. A radiator unit for an internal combustion engine of a vehicle, comprising:

a radiator disposed in the vicinity of the engine;

a shroud connected to the radiator so as to be located between the radiator and the engine, the shroud including a base frame which defines an opening and a plurality of stays which extend from the base frame toward a center of the opening;

a motor connected to the stays, and housed in a central opening of the shroud; and a fan connected to the motor and having a plurality of blades;

wherein the stays are located between the radiator and the fan, each of the stays being formed into a stationary blade shape which extends in a first predetermined direction at a first angle with respect to the fore-and-aft direction of the vehicle, and each blade of the fan extends in a second predetermined direction at a second angle with respect to the fore-and-aft direction of the vehicle, the first angle being different from the second angle; and wherein the fan blades and the stays extend adjacent each other with a constant clearance therebetween and are arranged such that a curved face of each stay which faces the fan blades is substantially complimentary to a curved face of said fan blade which faces the stays.

2. A radiator unit as claimed in claim 1, wherein said fan includes a cover portion which covers a side of said motor facing the engine.

3. A radiator unit as claimed in claim 1, wherein said shroud includes a cylindrical member surrounding said fan.

4. A radiator unit as claimed in claim 1, wherein each of said stays is curved toward the rotational direction of the motor.

5. A radiator unit as claimed in claim 1, wherein each of the stays is formed such that a front side thereof is directed against the rotational direction of said fan and said first angle is oblique with respect to the fore-and-aft direction of the vehicle, each of the blades of said fan being formed such that a front side thereof is directed toward the rotation direction of said fan and said second angle is oblique with respect to the fore-and-aft direction of the vehicle.

6. A radiator unit as claimed in claim 1, wherein said shroud includes an outer cover enclosing a part of the opening defined by the base frame.

7. A radiator unit as claimed in claim 1, wherein said shroud includes an outer cover integrally connected to said base frame and said stays to enclose openings defined by the base frame, the stays and the cylindrical member.

* * * * *